United States Patent [19]

Pan et al.

[11] Patent Number: 4,965,611

[45] Date of Patent: Oct. 23, 1990

[54] AMORPHOUS DIFFUSION BARRIER FOR THERMAL INK JET PRINT HEADS

[75] Inventors: Alfred I. Pan, Sunnyvale; Eric G. Hanson, Burlingame, both of Calif.

[73] Assignee: Hewlett-Packard Company, Palo Alto, Calif.

[21] Appl. No.: 327,078

[22] Filed: Mar. 22, 1989

[51] Int. Cl.[5] ..... B41J 2/05

[52] U.S. Cl. ..... 346/1.1; 346/140 R

[58] Field of Search ..... 346/140

[56] References Cited

U.S. PATENT DOCUMENTS

| | | | |
|---|---|---|---|
| 4,370,668 | 1/1983 | Hara | 346/140 |
| 4,490,728 | 12/1984 | Vaught | 346/140 X |
| 4,535,343 | 8/1985 | Wright | 346/140 |
| 4,596,994 | 6/1986 | Matsuda | 346/140 |
| 4,809,428 | 3/1989 | Aden | 346/140 |

*Primary Examiner*—Joseph W. Hartary

*Attorney, Agent, or Firm*—William H. F. Howard

[57] ABSTRACT

Disclosed is an improved thermal ink jet print head with an amorphous diffusion barrier that inhibits corrosion associated with ink. The head has a silicon substrate, a silicon dioxide insulating layer, a tantalum aluminum alloy (TaAl) resistive layer, and two separated gold conductive regions formed over the resistive layer. Ink is drawn into a channel bounded above by an orifice plate and below by the TaAl exposed between the two separated gold regions. The ink is superheated and expelled as fine droplets through the orifice plate. The invention minimizes corrosion by placing a thin corrosion-resistant layer of amorphous metallic alloy over the conductive layer, thereby improving durability of the print head.

7 Claims, 2 Drawing Sheets

POND TESTS WITH NO BARRIERS

AMORPHOUS DIFFUSION BARRIER FOR THERMAL INK JET PRINT HEADS

BACKGROUND OF THE INVENTION

The field of this invention generally is ink jet print head. More specifically, the present invention offers a method and apparatus for improving the reliability and extending the lifetime of thermal ink jet print heads.

The basic methods of fabricating conventional thermal ink jet print heads are well known to persons skilled in the art of non-impact printing. Currently available thermal ink jet print heads use an array of heating elements located beneath chambers that are each aligned with an orifice in a metal plate that is suspended over the chambers.

Ink inside the chambers is heated rapidly, forming superheated bubbles that are expelled through the tiny openings in the plate in a controlled explosion of ink. The fine droplets that are forced through each orifice impact on a sheet of paper located immediately in front of the metal plate. Complex patterns of ink emitted by the print heat form printed letters and numberals on the paper.

Conventional thermal ink jet print heads, however, require passivating coatings which are applied to both the conductive and resistive portions of the print head. These coatings are usually corrosion-resistance dielectric layers that seal out the ink and enhance the lifetime and reliability of the print head. The drawbacks that accompany this attempted solution include both a substantial reduction in thermal efficiency and an increase in the coase of fabrication of the final product. The development of a relatively low cost improved print head that does not suffer from the impediment of reduced thermal efficieny would represent a major technological advance in the computer printer business.

One attempt to improve the thermal efficieny and to reduce the fabrication cost of conventional print heads has been the elimination of these passivation coatins. In this approach, a corrosion-resistant noble metal such as gold is substituted for aluminum, which is generally employed as the conductive element. The problem with this attempted solution is that the unprotected conductive layers are then degraded by the ink with which they come into contact.

Inks used in thermal ink jet printers have a strong tendency to attack the conductive layer which forms the top layer of the print head. After a print head has been exposed to ink for a relatively short time, the ink begins to diffuse and migrate down in to the polycrystalline gold conductive layer along its grain boundaries. This migration gradually attacks the bonds between the gold and the resistive material, and causes the gold to separate (delaminate) from the resistive layer below it. The delamination of the gold from the heating element degrades the performance of the print head and ultimately destroys it. Even in the absence of the corrosive ink, humidity from the ambient air is a source of moisture which seeps into the gold and causes similar disintegration of the print head.

The development of a technique which avoids this delamination would represent a major technological advance in the computer printer business. The improved thermal efficiency and reduced cost of such an improved device compared to the conventional design would satisfy a long felt need within the industry.

SUMMARY OF THE INVENTION

The improved thermal ink jet print head disclosed and claimed in this patent application overcomes the problems of cavitation of resistive layers and delamination of noble metal conductive layers by ambient humidity and corrosive inks in print heads which do not incorporate passivating coatings.

Conventional thermal ink jet print heads incorporate a silicon substrate, an insulative layer of silicon dioxide over the substrate, a thin resistive layer of tantalum aluminum (TaAl) alloy formed over the silicon dioxide, two separated conductive regions of gold deposited above the resistive layer, and passivating coatings over the resistive and conductive layers. Ink is drawn by capillary action into a channel bounded on the bottom by these thin film layers and on the top by an orifice plate. When an electrical potential is established across a pair of conductive regions, a current flows between them through the resistive layer. The ink is superheated by the resistor and is expelled as fine droplets through the orifice plate.

The present invention uses a simple technique which eliminates the dielectric layers without the harmful effects that are previously encountered due to degradation of the conductive layers by corrosive ink. The inventors solve the problems encountered in previous print heads by depositing a thin, one hundred Angstrom layer of an amorphous metallic alloy over the gold regions. The amorphous structure of this coating acts as a diffusion barrier to water and ink molecules that come into contact with the gold conductive regions.

This invention provides an effective and efficient system that will enable engineers in the printer industry to construct more efficient, cost-effective, yet reliable printing equipment.

Other objectives of the invention and a more complete and understanding of it will come by studying the following description of a preferred embodiment and the accompanying drawings.

DETAILED DESCRIPTION OF THE PREFERRED EMBODIMENT

System Overview

Broadly stated, this invention provides a system including apparatus and method for fabricating an improved thermal ink jet print head [20] including the steps of: (a) forming a substrate [12]; (b) depositing an insulative layer [14] over the substrate [12]; (c) forming a thin film resistive layer [16] over the insulative layer [14]; (d) creating a conductive layer [18] above the resistive layer [16]; and (e) applying a coating of corrosion-resistant, amorphous metallic alloy [22] over the conductive layer [18].

System Details

Figure 1:
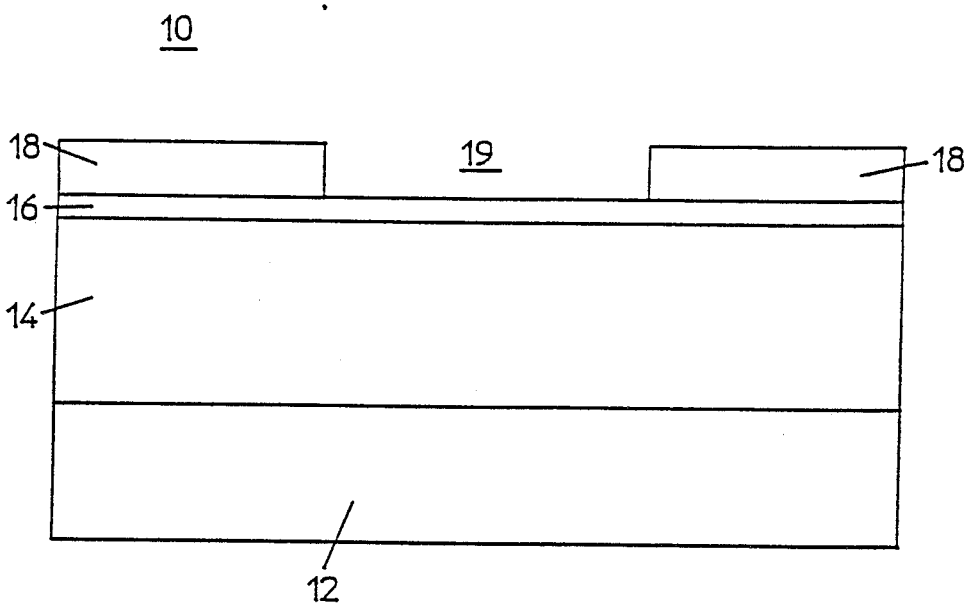
FIG 1. (Prior Art)
FIG. 1 is a schematic drawing of a cross-section of a portion of a conventional thermal ink jet print head which does not incorporate passivating coatings.

FIG. 1 shows a small portion of a conventional unpassivated thermal ink jet print head 10 in a cross-sectional view. A silicon substrate 12 forms the foundation of the print head 10 and is bounded above by a layer of silicon dioxide 14. The silicon dioxide layer 14 is typically 1.7 microns thick and acts as an insulator.

A thin coating of resistive material 16 such as tantalum aluminum alloy (TaAl) is deposited over the insulative layer 14. The TaAl is usually about 2000 Angstroms in depth. The topmost layer of the print head comprises two separated gold regions 18 that are typically 5000 Angstroms high. An aqueous or wax-based ink is drawn into ink heating region 19 over the resistive layer 16 by capillary action from a reservoir (not shown).

Figure 2:
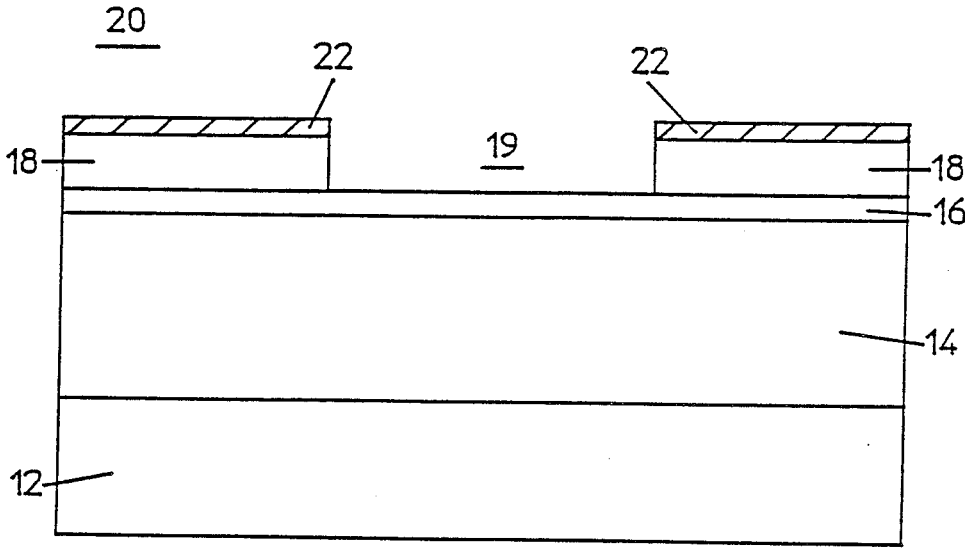
FIG. 2 is a schematic cross-sectional view of the present invention.

FIG. 2 shows how the inventors solve the problem of adhesion failure in multiple layers of thin films encountered in previous unpassivated print heads 10. This invention calls for depositing a thin, one hundred Angstrom layer of tantalum aluminum alloy 22 formed over the gold regions 18. The improved thermal ink jet print head 20 may employ any amorphous metallic alloy which presents a barrier to ink, moisture, or other contaminants that would otherwise diffuse down into the gold regions 18 and cause severe damage to the print head.

Although tantalum aluminum is the corrosion-resistant coating used in the preferred embodiment, titanium nitride or titanium tungsten may also be used with equal success. Any corrosion-resistance substance that is characterized by a dense structure without grain boundaries would be suitable for this purpose. Tantalum aluminum is especially preferred because it is also employed as the resistive layer 16. This dual use simplifies and lowers the cost of the fabrication of the print head.

The operation of the improved print head 20 is generally similar to that of previous thermal ink jet print heads. When an electrical potential is applied across a pair of two gold regions 18, current flows between them through the contiguous resistive layer 16. The ink is superheated and is expelled as fine droplets through an orifice plate (not shown) which is aligned above the region 19 and between each pair of gold regions 18. The new print head 20 is manufactured in accordance with sputtering techniques that are well known to persons skilled in the thermal ink jet print head art.

Figure 3:
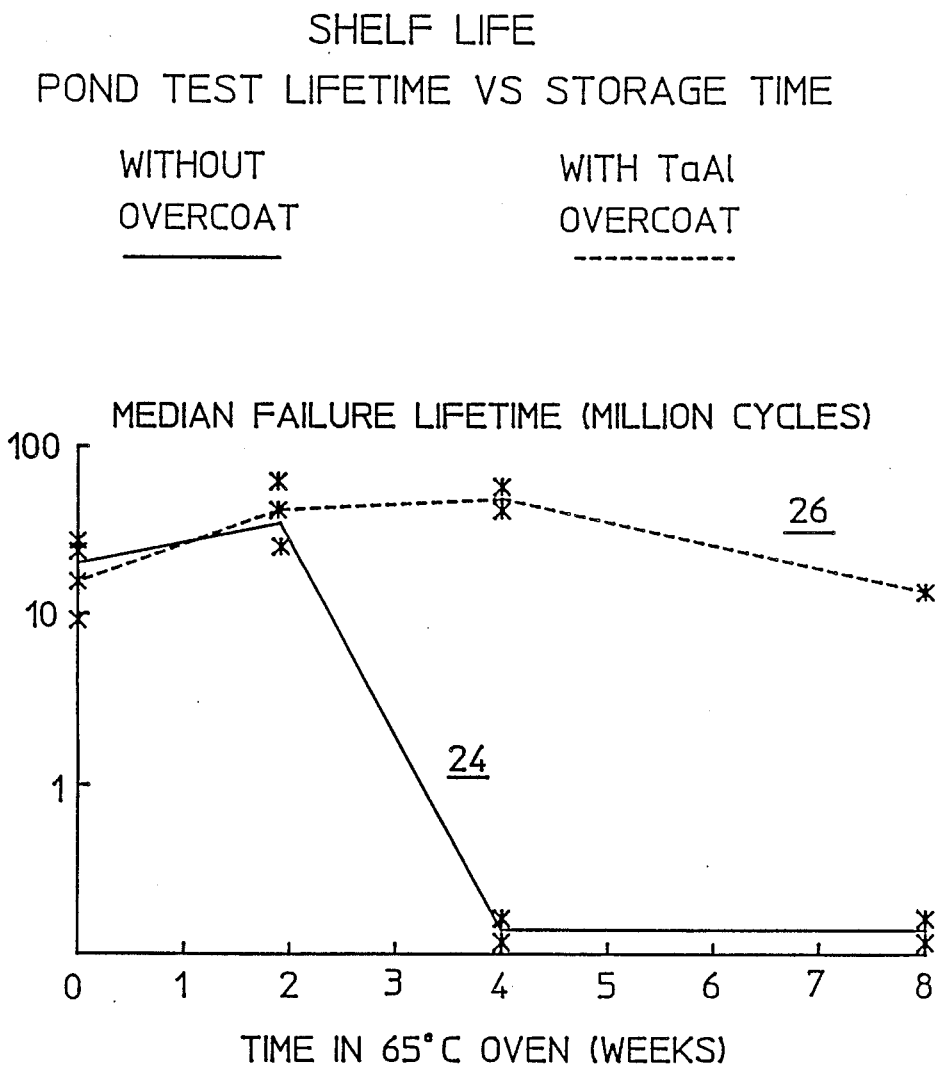
FIG. 3 is a graph of experimental data showing the dramatic extension of the useful lifetime of a print head that includes an amorphous diffusion barrier of this invention. In this graph, (a) the horizontal axis is the length of time a printhead has spent immersed in 65 degrees Centigrade ink to accelerate diffusion and corrosion aging mechanisms (i.e., the accelerated aging period), and (b) the vertical axis is the number of resistor heating cycles to failure, in millions of cycles, in a printhead lifetest conducted after the completion of the accelerated aging period.

FIG. 3 is a graph of experimental data that illustrates the dramatic extension of the useful lifetime of a print head that includes a TaAl overcoat 22 in comparison to a previous unpassivated print head. The horizontal axis and the vertical axis are defined above in the Brief Description of the Drawings.

The solid lower curve 24 in FIG. 3 reveals that the gold zones 18 on a conventional print head 10 immersed in ink for 8 weeks will fail, on average, after 100,000 cycles of operation. Dashed curve 26 shows that a similarly immersed print head 20 which incorporates the novel protective layer 22 operates successfully over the course of 10,000,000 cycles—an improvement of a full two orders of magnitude.

This data was generated by immersing the two different print heads in ink at 65 degrees Centigrade. After being submerged in the hot ink, a 3 KHz pulse input was applied to the heads in room temperature ink that produced 3000 bubbles of ink per second. The print heads were operated without orifice plates or thick-film barriers until they failed. The operation without an orifice plate or thick-film barriers hastens the failure of the print head, since this mode of operation increases the impact stress caused by the ink bubbles when they collapse on the resistor which had superheated the ink.

The amorphous diffusion barrier for thermal ink jet print heads provides a low cost yet highly reliable system that eliminates the need for passivation layers, resists corrosion, and assures a long life for the print head. This invention constitutes a major step forward in the continually evolving field of ink jet printers.

The invention claimed is:

1. A method of fabricating an improved thermal ink jet print head including the steps of:
   a. forming a substrate;
   b. depositing an insulative layer over the substrate;
   c. forming a thin film resistive layer over the insulative layer, the resistive layer being intentionally left unpassivated;
   d. creating a conductive layer above the resistive layer; and
   e. applying a coating of corrosion-resistant amorphous metallic alloy over the conductive layer while avoiding applying the alloy over the resistive layer, the alloy thus serving as a diffusion barrier.

2. The method defined in claim 1, wherein the substrate is silicon.

3. The method defined by claim 1, wherein the insulative layer is silicon dioxide.

4. The method defined by claim 1, wherein the resistive layer is tantalum aluminum.

5. The method defined by claim 1, wherein the conductive layer is gold.

6. The method defined by claim 1, wherein the amorphous metallic alloy is tantalum aluminum.

7. A corrosion-resistant integrated ink jet print head for expelling an ink droplet from a heated region, the head comprising:
   a. a silicon substrate;
   b. an insulative silicon dioxide layer formed over the substrate;
   c. an unpassivated resistive heating layer deposited over the insulative layer, the resistive heating layer being formed from tantalum aluminum alloy;
   d. a conductive layer including at least a pair of discrete gold layers, the gold layers being deposited over the resistive heating layer, each pair of discrete gold layers together with the resistive heating layer defining the heated region; and
   e. a top layer of corrosion-resistant amorphous metallic alloy, applied over the conductive layer but not applied over the resistive heating layer, which serves as a diffusion barrier that inhibits the diffusion of the ink droplet into the gold layers, thus avoiding corrosion of the gold layers by the ink.

* * * * *